US008413707B2

(12) United States Patent
Hadano et al.

(10) Patent No.: US 8,413,707 B2
(45) Date of Patent: Apr. 9, 2013

(54) MOLDING PROCESS FOR SIMULTANEOUSLY MAKING AN UPPER MOLD AND A LOWER MOLD AND A FLASKLESS MOLDING MACHINE

(75) Inventors: Yutaka Hadano, Toyokawa (JP); Takayuki Komiyama, Toyokawa (JP); Shuji Takasu, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 0 days.

(21) Appl. No.: 13/131,288

(22) PCT Filed: Dec. 25, 2009

(86) PCT No.: PCT/JP2009/071556

§ 371 (c)(1),
(2), (4) Date: May 26, 2011

(87) PCT Pub. No.: WO2011/052100

PCT Pub. Date: May 5, 2011

(65) Prior Publication Data

US 2012/0199306 A1 Aug. 9, 2012

(30) Foreign Application Priority Data

Oct. 28, 2009 (JP) ..... 2009-248020
Nov. 5, 2009 (JP) ..... 2009-253667

(51) Int. Cl.
*B22C 9/20* (2006.01)

(52) U.S. Cl. ..... 164/22; 164/200

(58) Field of Classification Search ..... 164/200–202, 164/19–22

See application file for complete search history.

(56) References Cited

U.S. PATENT DOCUMENTS 5,246,058 A * 9/1993 Murata ..... 164/182

FOREIGN PATENT DOCUMENTS

JP 59-24552 2/1984
JP 64-18547 1/1989

OTHER PUBLICATIONS

International Search Report dated Mar. 2, 2010 issued in corresponding International Application No. .PCT/JP209/071556.

* cited by examiner

*Primary Examiner* — Kuang Lin
(74) *Attorney, Agent, or Firm* — Finnegan, Henderson, Farabow, Garrett & Dunner, L.L.P.

(57) ABSTRACT

A process and machine for simultaneously making an upper and lower flaskless mold, the process including defining a lower molding space by a drag flask that can enter or leave a molding space in which the molds are made, a match plate having patterns on the upper and lower surfaces and mounted on an upper surface of the drag flask, a lower filling frame provided with molding-sand introducing ports and connectable to the lower end of the drag flask to allow the lower filling frame to ascend and descend, and an ascendable and descendable lower squeeze board, and defining an upper molding space by a cope flask provided with molding-sand introducing ports and being mountable on the match plate to allow the cope flask to ascend and descend, and an upper squeeze board that is opposed to and fixedly provided above the match plate; simultaneously introducing molding sand into the upper and lower molding spaces; squeezing the molding sand by raising the lower squeeze board to make the upper mold and a lower mold; drawing the upper molds from the match plate; and stripping the upper mold from the cope flask, while stripping the lower filling frame from the lower mold.

8 Claims, 10 Drawing Sheets

MOLDING PROCESS FOR SIMULTANEOUSLY MAKING AN UPPER MOLD AND A LOWER MOLD AND A FLASKLESS MOLDING MACHINE

TECHNICAL FIELD

This invention relates to a process for making molds and a molding machine. More specifically, this invention relates to a molding process and a flaskless molding machine for simultaneously making an upper flaskless mold and a lower flaskless mold.

BACKGROUND OF THE INVENTION

Conventionally, to simultaneously make an upper flaskless mold and a lower flaskless mold, for instance, a flaskless molding machine for simultaneously making an upper mold and a lower mold as disclosed in Patent Literature 1 is known.

However, this conventional molding machine involves a problem in which a lower squeeze board is inclined during a squeezing step, and thus the bottom surfaces of the molds to be made are inclined relative to a horizontal plane. In particular, if the profile of a pattern is eccentrically located at one side of a pattern plate, an uneven primary filling of molding sand may increase the tendency to incline. To prevent such an inclination, it may be considered to provide a guide rod to inhibit the inclination of the lower squeeze board. However, this approach involves a problem in that the guide rod may be deformed by the compression force from the squeezing step. Further, a configuration may be complicated by providing the guide rod.

In the conventional flaskless molding machine for simultaneously making the upper and lower molds in Patent Literature 1, it is now assumed that the respective molds are drawn from the mated flasks ("stripping the flasks") after the molds are completely compressed. In this condition, because the stroke of stripping the flasks equals just the thickness of a match plate and thus it is relatively shorter, it causes the stripped flasks to become unstable. Namely, in this conventional molding machine, after the compression is completed, the lower squeeze board then descends to retract a drag flask and a master plate from the molding position. Then, a squeeze cylinder for setting the flasks ascends such that a stopper pin on the upper surface of a lower filling frame contacts the lower surface of a cope flask. However, because the gap between the upper surface of the drag flask and the lower surface of the cope flask equals just the thickness of the match plate, the maximum length of the cope flask stripping stroke cannot be equal to or greater than the thickness of the match plate. For instance, if the thickness of the match plate is 10 mm, the length of the cope flask stripping stroke is inevitably less than 10 mm.

PRIOR-ART DOCUMENT

[Patent Literature 1] Japanese Patent Laid-open Publication No. Tokkaishou 59-24552

SUMMARY OF THE INVENTION

Problems to be Solved by the Invention

One object of the present invention is to solve the above problem and to provide a molding process and a flaskless molding machine for simultaneously making an upper flaskless mold and a lower flaskless mold such that the bottom surfaces of the molds can be in the horizontal position, the stripping of the flasks can be reliably carried out, and the configuration of the molding machine can be simplified.

Means to Solve the Problems

To achieve the object, the molding process for simultaneously making an upper mold and a lower mold of the present invention comprises the steps of defining a lower molding space by a drag flask that is arranged to enter or leave a molding space in which molds are made, a match plate having patterns on the upper and lower surfaces and mounted on the upper surface of the drag flask, a lower filling frame provided with molding-sand introducing ports on the surfaces of the sidewalls and being connectable to the lower end of the drag flask to allow the lower filling frame to ascend and descend, and an ascendable and descendable lower squeeze board, the step also defining an upper molding space by a cope flask provided with molding-sand introducing ports on the surfaces of the sidewalls and being mountable on the match plate to allow the cope flask to ascend and descend, and an upper squeeze board that is opposed to and fixedly provided above the match plate; simultaneously introducing molding sand into the upper molding space and the lower molding space; squeezing the molding sand by raising the lower squeeze board to simultaneously make an upper mold and a lower mold; drawing the upper mold from the pattern on the upper surface of the match plate, while drawing the lower mold from the pattern on the lower surface of the match plate; and stripping the upper mold from the cope flask, while stripping the lower filling frame from the lower mold.

To achieve the object, the flaskless molding machine of the present invention comprises an ascendable and descendable lower squeeze board; a lower filling frame having molding-sand introducing-ports on the surfaces of sidewalls, wherein the lower filling frame is ascendable and descendable independently from and simultaneously with the lower squeeze board; a lower squeeze unit that includes the lower filling frame, the lower squeeze board, and a lower squeeze frame, wherein the lower filling frame is connected to the leading ends of rods of a plurality of the lower filling frame's cylinders, and wherein the lower filling frame's cylinders are mounted on the lower squeeze frame in the upward direction, and wherein the lower squeeze frame is ascendably and descendably mounted on at least two columns; an upper squeeze board that is opposed to and fixedly provided above the lower squeeze board; an ascendable and descendable cope flask having molding-sand introducing-ports on the surfaces of sidewalls; a drag flask that is configured to enter, and leave from, a position intermediate between the lower squeeze board and the upper squeeze board, wherein a match plate is mounted on the upper surface of the drag flask; and an air cylinder fixedly mounted on an upper frame such that the contraction of the piston rod of the air cylinder raises the cope flask.

As used herein, the wording "the lower filling frame is ascendable and descendable independently from and simultaneously with the lower squeeze board" means that only the lower filling frame can ascend and descend by means of the lower filling frame's cylinders, independently from the lower squeeze board, while the lower filling frame and the lower squeeze board can ascend or descend at the same time when the lower squeeze board ascends or descends by means of the flasks-set and squeeze cylinder.

The body of the lower squeeze board may be composed of stiff material such as a synthetic resin or metal. The lower squeeze board may be elastic material such as a rubber.

The actuators in the present invention may employ a hydraulic cylinder, an air cylinder, or an electric cylinder. However, because piping and a hydraulic pump are necessary for the hydraulic cylinder, it may be desirable to employ the electric cylinder, to simplify the configurations of the squeeze board as well as the actuators.

In the present invention, the flasks-set and squeeze cylinder can use an air-on-oil activation. As used herein, the term "air-on-oil activation" refers to a driving scheme to transform a pneumatic low-pressure to a hydraulic pressure to be used based on the hybrid functionality of the pneumatic pressure and the hydraulic pressure. The present invention may have no use for a hydraulic pump, but can use a booster cylinder that utilizes Pascal's principle and an air-pressure source.

In the present invention, the required number of cylinders of the cope flask is at least one. Because the work-hours for laying out a piping arrangement can be reduced as the number of cylinders of the cope flask is reduced, preferably just one cylinder is to be used.

Although the term "molding sand" in the present invention does not identify the types of it, green sand, for instance, using a bentonite as a bonding agent, may be preferred.

Advantages of the Invention

In the present invention, the cope flask can ascend and descend by means of the actuator during the stripping step. Such a configuration has no need for the stopper pin as disclosed in Patent Literature 1. This provides an advantage in that the structure of a squeeze mechanism can be simplified. Further, a stable stripping of the flasks can be achieved, since the stroke for stripping each flask increases in length.

In the present invention, the lower squeeze board is integrally configured with the lower squeeze frame that is ascendably and descendably mounted on at least two columns, to achieve an advantage in which the strength of the squeeze mechanism is enhanced such that the bottom surfaces of the molds are stable in the horizontal position.

Further, in the present invention, the lower filling frame can be configured such that it is connected to the leading ends of the lower filling frame's cylinders that are mounted on the lower squeeze frame in the upward direction. Such a configuration can increase a mechanical stiffness during the molding step, so as to make stable molds. In addition, there is an advantage in which a peripheral arrangement around the lower squeeze board can be simplified.

The above and other characteristics and advantages will be better understood in considering the following embodiment in reference to the appended drawings.

BRIEF DESCRIPTION OF THE DRAWINGS

FIG. 4 is a schematic view of the molding machine in the initial position.

FIG. 5 is a schematic view of the molding machine at the step of supplying the sand.

FIG. 6 is a schematic view of the molding machine at the step of compressing the sand.

FIG. 7 is a schematic view of the molding machine when the step of stripping the flasks is completed.

FIG. 8 is a schematic view of the molding machine when the setting aside of the drag flask is completed.

FIG. 9 is a schematic view of the molding machine at the step of stacking the flasks.

FIG. 10 is a schematic view of the molding machine when the step of stripping the cope flask is completed.

FIG. 11 is a schematic view of the molding machine when the step of stripping the drag flask is completed.

EMBODIMENTS TO CARRY OUT THE INVENTION

Embodiment 1

Figure 1:
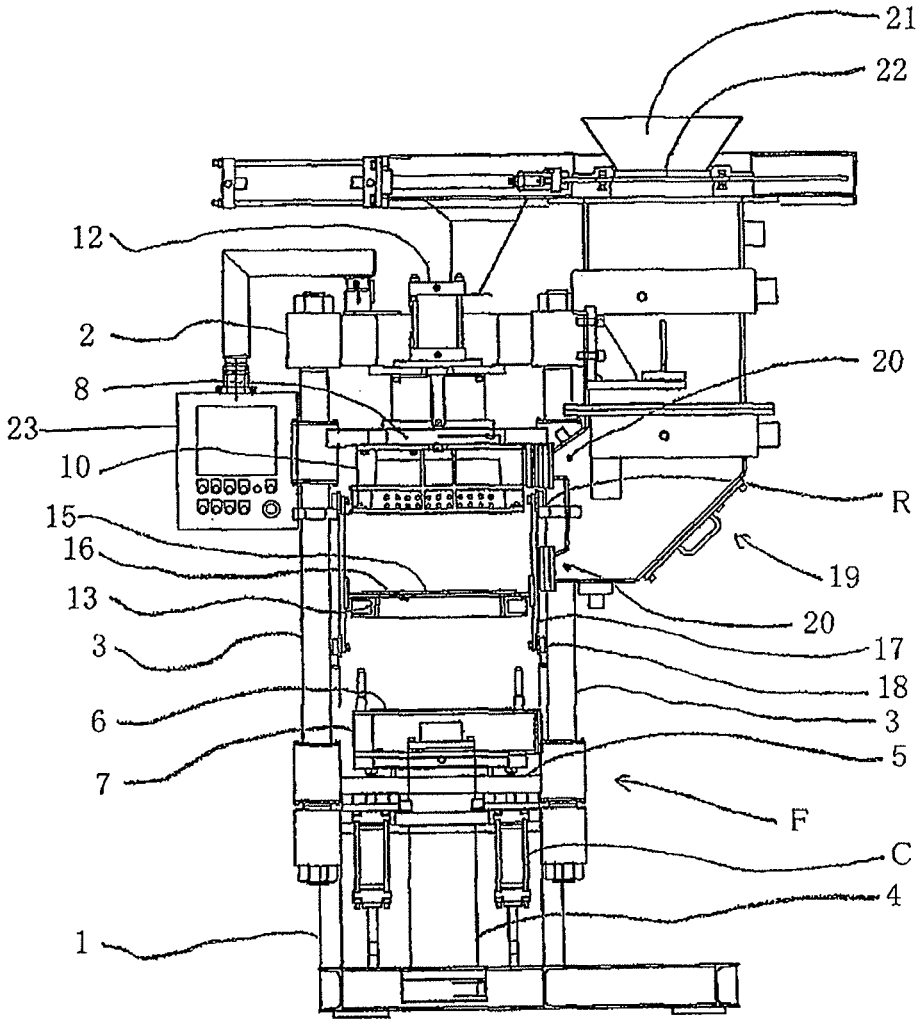
FIG. 1 is a schematic front view of the flaskless molding machine of one embodiment of the present invention.
Figure 2:
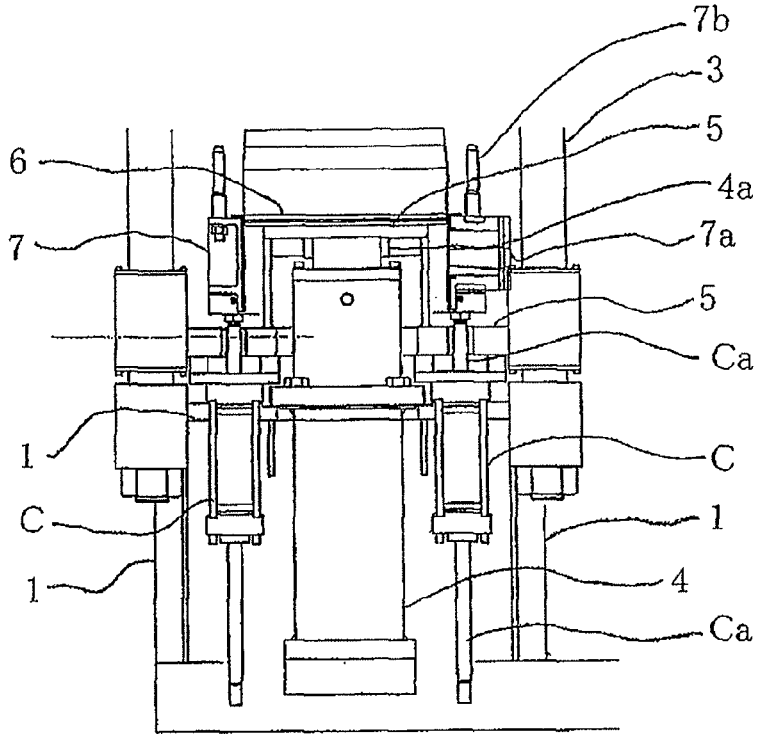
FIG. 2 is a schematic enlarged view around the lower squeeze board of the molding machine of FIG. 1.

The present invention will now be explained by reference to the drawings. FIG. 1 is a schematic front view of a flaskless molding machine of one embodiment of the present invention. FIG. 2 is a schematic enlarged view around a lower squeeze board of the molding machine of FIG. 1.

In FIGS. 1 and 2, a gantry frame F is configured such that a lower base frame 1 and an upper frame 2 are integrally coupled to each other through columns 3, 3 at the four corners of each frame. On the center of the upper surface of the lower base frame 1, a cylinder 4 for setting the flasks and for squeezing sand (the "flasks-set and squeeze cylinder") is mounted vertically. The leading end of a piston rod 4*a* of the flasks-set and squeeze cylinder 4 is connected to a lower squeeze board 6 through a lower squeeze frame 5. The four corners of the lower base frame 1 are provided with sliding bushes, each being at least 10 mm or more in height, to securely maintain the lower squeeze frame 5 horizontally. Mounted on the periphery of the flasks-set and squeeze cylinder 4 on the center of the lower squeeze frame 5 are four cylinders C, C of a lower filling frame 7 (the "lower filling frame's cylinders"). The leading ends of the respective piston rods Ca of the cylinders C are connected to the lower filling frame 7. The lower squeeze frame 5 has a center opening through which the main body of flasks-set and squeeze cylinder 4 is inserted.

The lower filling frame 7 has an opening that is proportioned such that the lower squeeze board 6 can be hermetically fitted in it. The opening is formed to become narrower along the downward direction. The surface of the side walls defining the opening are provided with molding sand introducing-ports 7*a*.

The lower squeeze board 6 is integrally configured with the lower squeeze frame 5 such that raising the flasks-set and squeeze cylinder 4 causes the lower squeeze board 6 to ascend. Then, the lower squeeze board 6 can be raised along with the four lower filling frame's cylinders C, C, which are connected to the lower squeeze frame 5. The lower filling frame's cylinders C, C can be actuated independently from and simultaneously with the flasks-set and squeeze cylinder 4. Namely, the lower filling frame 7 is connected to the upper leading end of the rods Ca of the plurality of the lower filling frame's cylinders C that are mounted vertically on the lower squeeze frame 5. The lower squeeze frame 5 is ascendably and descendably mounted on at least two columns 3, 3. A lower squeeze unit is configured to include the lower squeeze board 6 and the lower squeeze frame 5 such that they are made to ascend and descend in unison. Further, a positioning pin 7*b* stands on the upper surface of the lower filling frame 7.

Opposite the lower squeeze board 6, an upper squeeze board 8 is fixedly mounted on the lower surface of the upper frame 2.

A cope flask 10 has an opening that is proportioned such that the upper squeeze board 8 can be hermetically fitted in it. The opening is formed such that it becomes wider along the downward direction. The surface of the side walls defining the opening are provided with molding sand introducing-ports 10*a*.

Figure 3:
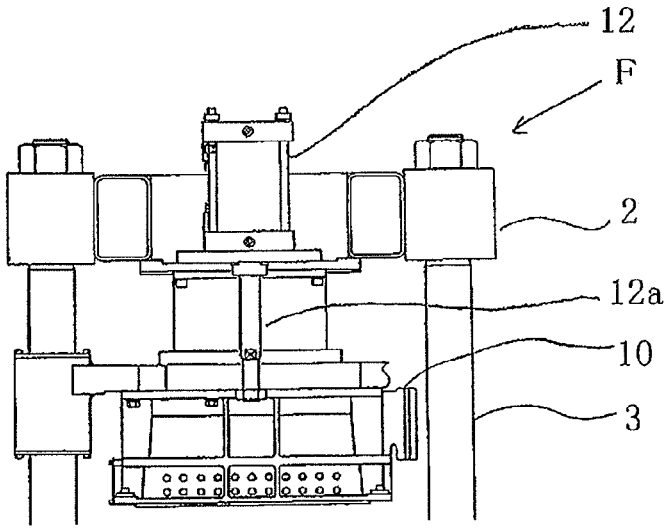
FIG. 3 is a schematic view around the cylinder of the cope flask of the molding machine of FIG. 1.

As shown in FIG. 3, on the upper frame 2, a cylinder 12, as, for instance, an air cylinder, of the cope flask, is fixedly mounted in a downward direction. Further, a piston rod 12*a* of the cylinder 12 is connected to the cope flask 10 such that the retraction of the piston rod 12*a* raises the cope flask 10.

At the position intermediate between the upper squeeze board 8 and the lower squeeze board 6, an interval therebetween is maintained such that the drag flask 13 can pass through therebetween. Square-bar shaped traveling-rails R are provided and passed through the columns 3, 3 along the back and forth direction. On the upper surface of the drag flask 13, a match plate 15 having patterns on its upper and lower surfaces is mounted through a master plate 16. The four corners of the drag flask 13 are provided with flanged rollers 18 through roller arms 17. Further, an aeration tank 19 is configured such that its distal end is divided to form fork-like sand-introducing ports 20. On the top of the aeration tank 19, a sand gate 22 having a molding-sand supplying opening 21 is located.

The numeral 23 in FIG. 1 denotes a control panel for controlling the molding machine. For instance, the control panel may include, but is not limited to, a touch panel.

Figure 4:
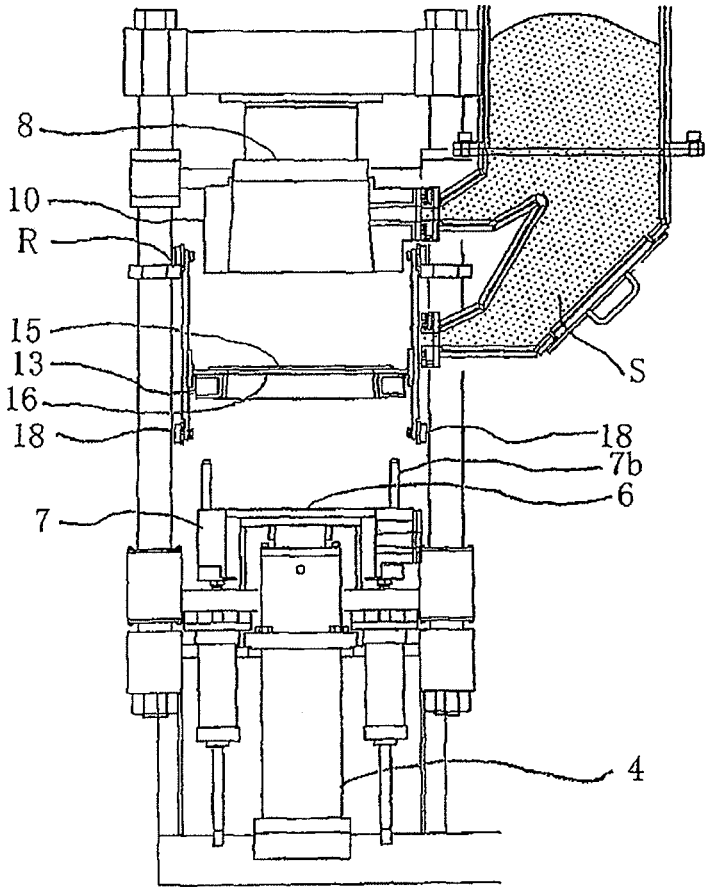
FIGS. 4-11 illustrate the steps of the molding process of the present invention using the molding machine of FIG. 1.

In reference to FIGS. 4 through 11, the molding process of the present invention will now be explained in line with the operation of the above-described flaskless molding machine of the present invention. FIG. 4 illustrates the initial position of the molding machine. In FIG. 4, the drag flask 13 on which the match plate (or pattern plate) is fixedly loaded through the master plate 16 enters the interval between the lower squeeze board 6 and the upper squeeze board 8 and stops, while the flanged rollers 18 are engaged with the traveling rails R (see FIG. 4).

The lower filling frame's cylinders C and the flask-set and squeeze cylinder 4 are then actuated and raised, to raise the lower filling frame 7 and the lower squeeze board 6, so as to insert the positioning pin 7*b* into a corresponding positioning hole (not shown) of the drag flask 13 such that the lower filling frame 7 is stacked on the lower surface of the drag flask 13. Thus, a lower molding space is hermetically defined by the lower squeeze board 6, the lower filling frame 7, the drag flask 13, and the match plate 15. The lower squeeze board 6, the lower filling frame 7, the drag flask 13, and the match plate 15 are then raised in unison, so as to insert the positioning pin 7*b* into the lower surface of the cope flask 10 such that the drag flask 13 is stacked on the lower surface of the cope flask 10 through the match plate 15 and the master plate 16. Thus, an upper molding space is hermetically defined by the upper squeeze board 8 and the associated components.

In this state, the molding-sand introducing ports 7*a* of the lower filling frame 7 are aligned with the sand introducing ports 20 of the aeration tank 19.

Figure 5:
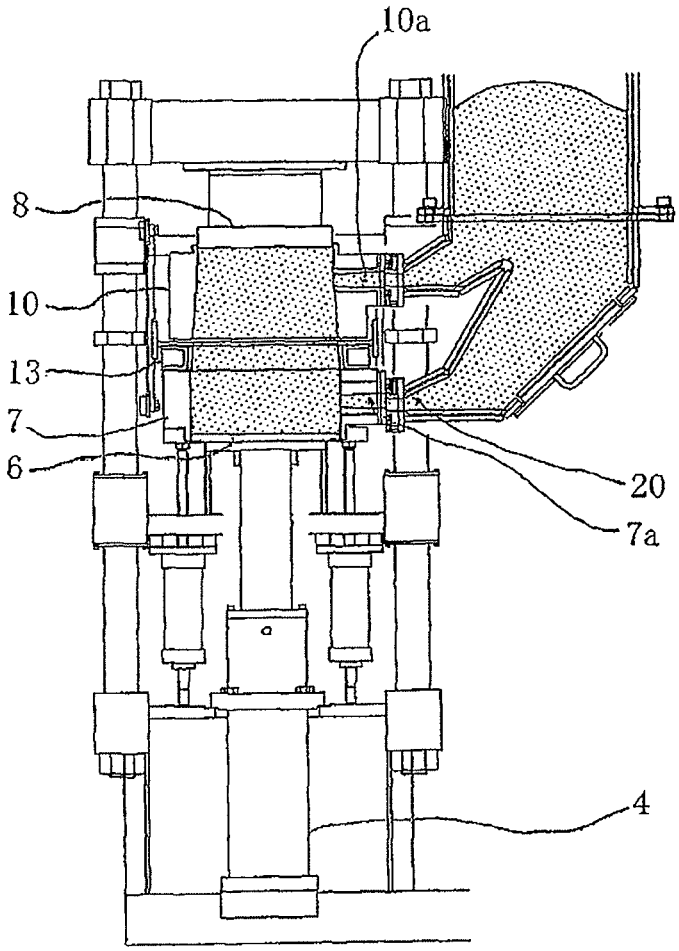
Figure 6:
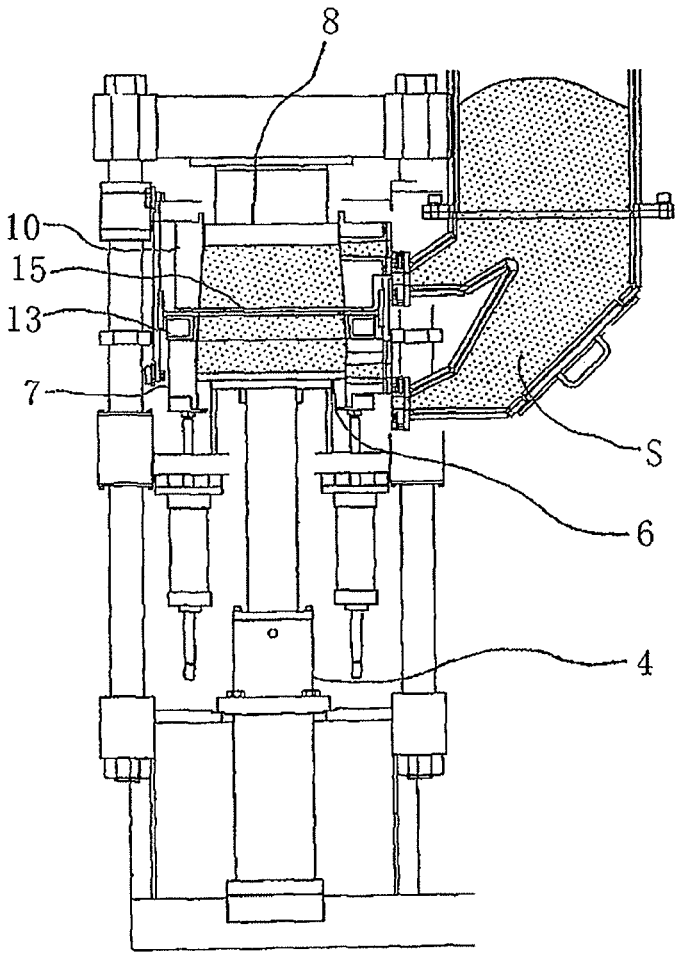

Supplying compressed air to the aeration tank 19 after the sand gate 22 is closed introduces the molding sand S from inside the aeration tank 19 into the upper and lower closed molding spaces, through the sand introducing ports 10*a* of the cope flask 10 and the molding-sand introducing ports 7*a* of the lower filling frame 7 (see FIG. 5). In this step, only the compressed air is exhausted to the exterior via exhaust vents (not shown) that are provided on the surfaces of the sidewalls of the cope flask 10 and the drag flask 13.

The flasks-set and squeeze cylinder 4 is then actuated to push and raise the lower filling frame 7, the drag flask 13, the match plate 15, and the cope flask 10. Simultaneously, the cylinder 4 causes the molding sand S within the upper and lower closed molding spaces to be sandwiched and compressed by the upper squeeze board 8 and the lower squeeze board 6, to squeeze the molding sand S (see FIG. 6).

Figure 7:
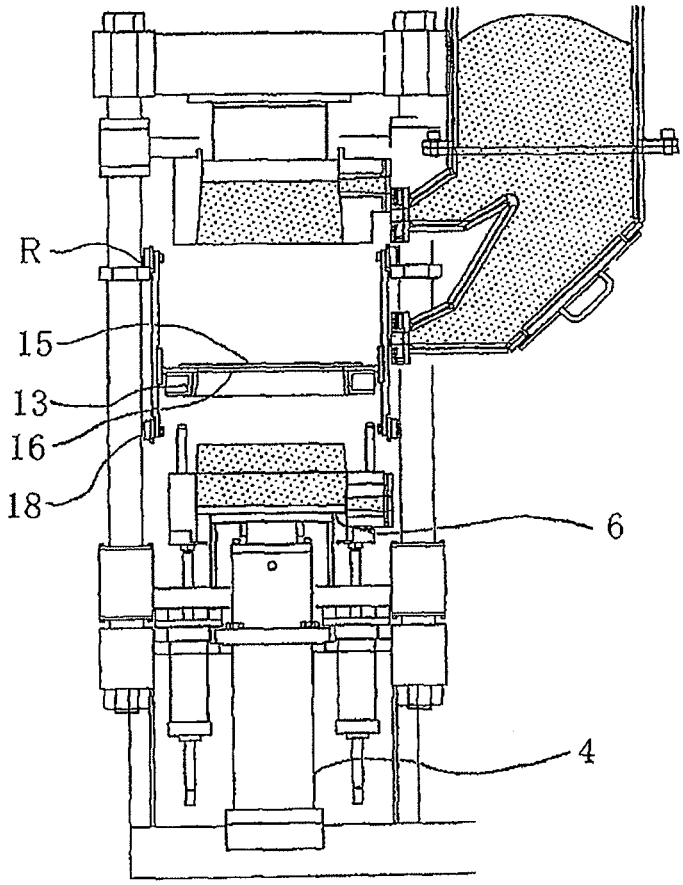

After the squeezing step is completed, the flasks-set and squeeze cylinder 4 is retracted to lower the lower squeeze board 6 to leave the drag flask 13, the match plate 15, and the master plate 16 on the travelling rails R through the flanged rollers 18 (see FIG. 7).

The flasks-set and squeeze cylinder 4 is further retracted and lowered to its initial position. The cylinder 4 is then stopped at the initial position. The lower filling frame 7 remains in the state it is in relative to the lower mold when the squeezing step is completed, while the lower squeeze board 6 is lowered to its initial position by lowering the flasks-set and squeeze cylinder 4 to its initial position.

Figure 8:
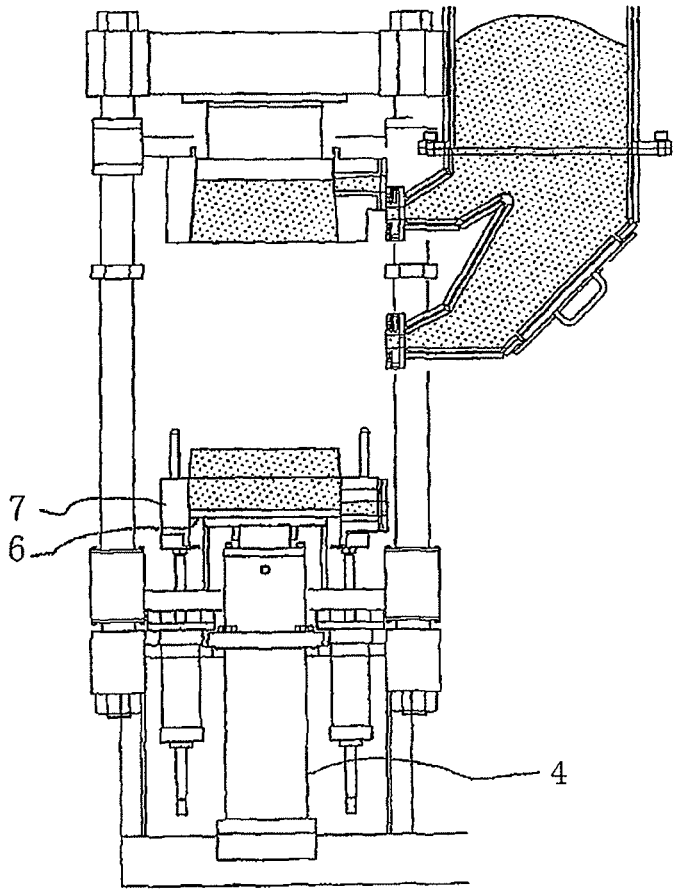

The drag flask 13, the match plate 15, and the master plate 16 are then retracted from the location in which the molding step is carried out such that a core can be set, if such is desired (see FIG. 8). However, the setting of the core does not constitute an essential feature of the present invention.

Figure 9:
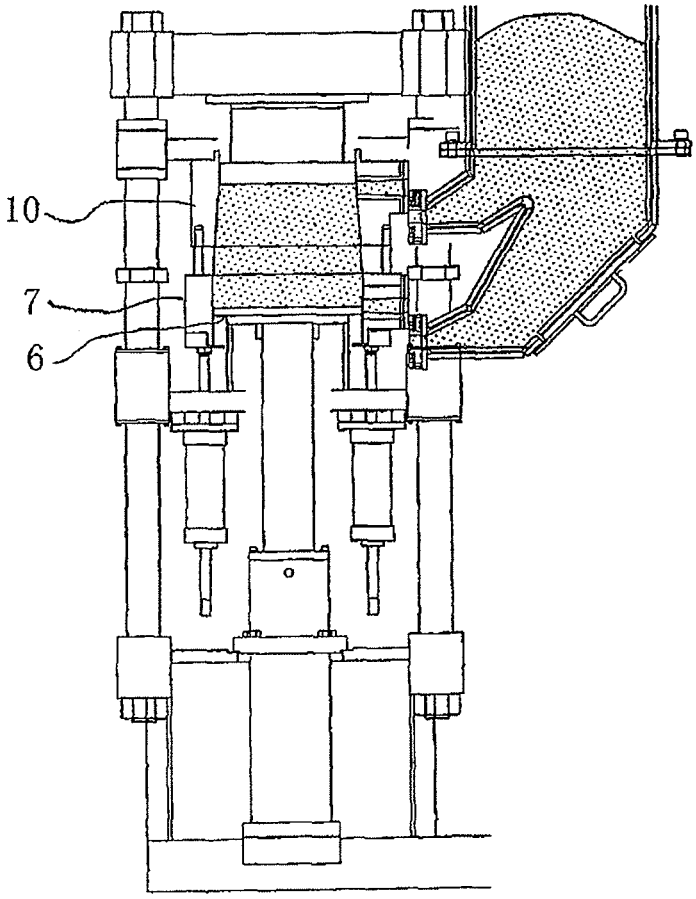
Figure 10:
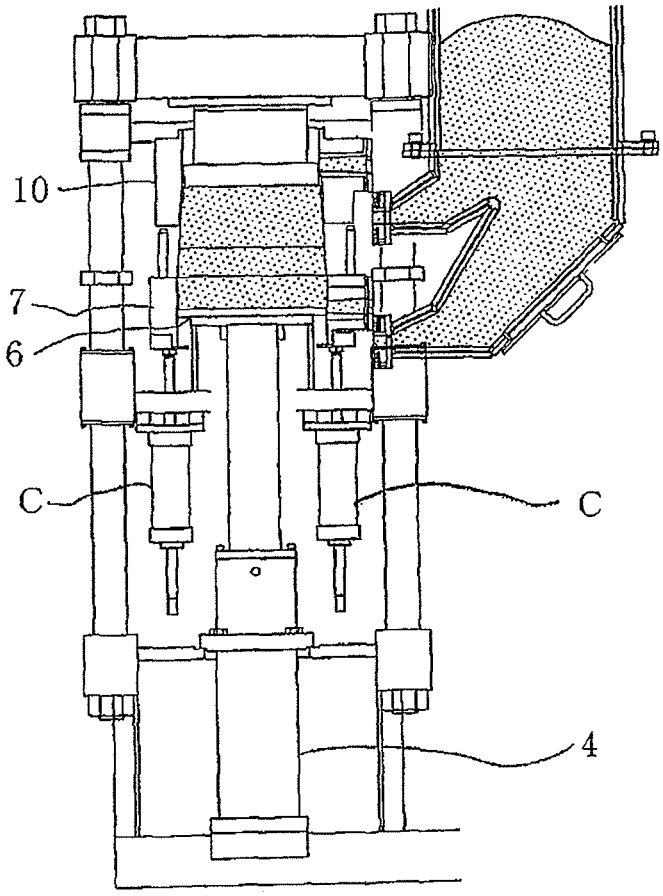
Figure 11:
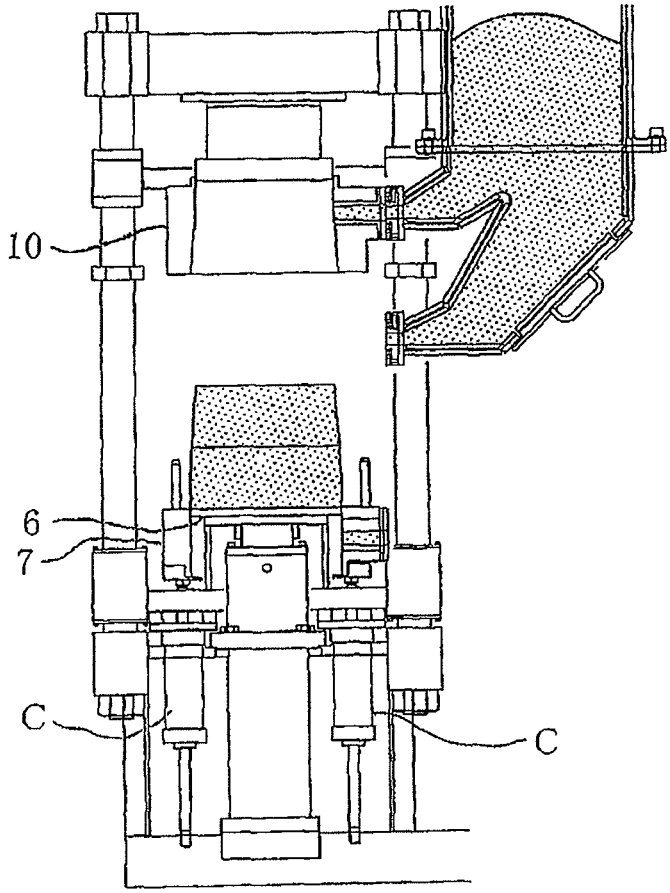

After the setting of the core (if necessary) is completed, the flasks-set and squeeze cylinder 4 is extended again, to raise the lower squeeze board 6 so as to contact the drag flask with the cope flask (see FIG. 9). In this state, the cylinder 12 of the cope flask is activated and raised to strip the upper mold from the cope flask 10 (see FIG. 10).

Because the ascending output power of the flasks-set and squeeze cylinder 4 is set at less than that in the squeezing process, the mold can be prevented from collapsing. After the upper mold is stripped, the flasks-set and squeeze cylinder 4 is then lowered to lower the lower squeeze board 6, while the piston rods Ca of the lower filling frame's cylinders (the leading ends of the respective piston rods Ca of the cylinders C are connected to the lower filling frame 7) are activated and retracted. The lower mold is thus stripped from the drag flask such that the molds are readied to be pushed out (see FIG. 11). The upper and lower molds on the upper surface of the lower squeeze board 6 are pushed out to the side of the conveying line by means of a pushing board (not shown) for pushing out the molds.

It should be understood from the above descriptions of this embodiment that because the lower squeeze board 6 is integrally configured with the squeeze frame 5, which is ascendably and descendably mounted on the four columns, the squeeze board 6 can be prevented from inclining during the squeezing step, even if the pattern or patterns are eccentrically located on the match plate 5. Therefore, each mold has an excellent quality in which the bottom surface, which is horizontal, can be stably made. Further, because the lower filling frame 7 and the lower squeeze board 6 are raised and lowered in unison, the configuration can be simplified.

AVAILABILITY IN THE INDUSTRY

Although the embodiment employs four columns, there can be as few as two. If the number of the columns is two, there is a merit in that the number of the columns is minimized. If the number of columns is four, as in the embodiment, because they form a profile similar to that of the cross section of each flask, they preferably provide a balanced strength.

Although the embodiment employs aeration to introduce the molding sand, it may employ a blow instead. As used herein, the term "aeration" refers to introducing the molding sand with compressed air having a low range of pressure, i.e., from 0.05 MPa to 0.18 MPa. The term "blow" refers to introducing the molding sand with compressed air having a high range of pressure, i.e., from 0.2 MPa to 0.35 MPa.

Further, in the embodiment, an electric cylinder may be used as an air cylinder.

In addition, it is desirable that the surface of the columns be treated, e.g., by a plate processing, in order to promote the sliding movement of the bushings of the lower squeeze frame. In this case, it is preferable that the bottom ends of the columns be coupled to a platform of the base frame such that the bottom ends are higher than the base. This configuration prevents the columns from being deflected, and minimizes the high plate processing cost. The length of each of the bushings that are provided at the four corners of the lower squeeze frame may be 50 cm or more, to ensure the parallelism so as to maintain the lower squeeze frame horizontal. In addition, in the lower squeeze frame 5 has a rectangle-shaped convex structure in the center in cross section. Inside the convex structure is a hollow structure in which both an upper portion of a body and a piston rod of the flasks-set and squeeze cylinder can be protruded to the inside of the convex structure from a lower rim thereof. This hollow convex structure may have a trapezoidal shape. The hollow convex structure in which both the upper portion of the body and the piston rod of the flasks-set and squeeze cylinder can be inserted may make the height of the molding machine lower. Although each of the lower filling frame's cylinders in the embodiment is a two-way rod, it may instead be a one-way rod.

Nevertheless, it will be understood that various modifications may be made without departing from the spirit and scope of the invention.

The invention claimed is:

1. A molding process for simultaneously making an upper mold and a lower mold, the process comprising the steps of:

defining a lower molding space by a drag flask that can enter or leave a molding space in which molds are made, a match plate having patterns on upper and lower surfaces and mounted on an upper surface of the drag flask, a lower filling frame provided with a molding-sand introducing port on a surface of a sidewall thereof and being connectable to a lower end of the drag flask to allow the lower filling frame to ascend and descend, and an ascendable and descendable lower squeeze board, and defining an upper molding space by a cope flask provided with a molding-sand introducing port on a surface of a sidewall thereof and being mountable on the match plate to allow the cope flask to ascend or descend, and an upper squeeze board that is opposed to and fixedly provided above the match plate;

simultaneously introducing molding sand into the upper molding space and the lower molding space;

squeezing the molding sand in the upper and lower molding spaces by raising the lower squeeze board to simultaneously make an upper mold and a lower mold in said spaces;

drawing the upper mold from the pattern on the upper surface of the match plate, while drawing the lower mold from the pattern on the lower surface of the match plate; and stripping the upper mold from the cope flask, while stripping the lower filling frame from the lower mold wherein the lower filling frame, the lower squeeze board, and a tower squeeze frame constitute a lower squeeze unit, in which the lower filling frame is ascendable and descendable independently of and simultaneously with the lower squeeze board, the lower squeeze frame is ascendably and descendably mounted on at least two columns, and wherein a plurality of cylinders of the lower filling frame are mounted on the lower squeeze frame in an upward direction such that leading ends of piston rods of the cylinders of the lower filling frame are attached to the lower filling frame, and wherein the lower squeeze unit is being defined while the lower squeeze unit ascends in unison or at an ascending end.

2. The process of claim 1, wherein the upper molding space is defined after the lower molding space is defined.

3. The process of claim 1, wherein the lower molding space is defined while the drag flask is stacked on a lower surface of the cope flask through the match plate such, that the upper molding space is hermetically defined by the upper squeeze board.

4. The process of any one of claims 1, 2, and 3, wherein the stripping of the cope flask from the upper mold is carried out by raising the cope flask by means of an actuator.

5. The process of claim 4, wherein the stripping of the cope flask from the upper mold is carried out by raising the cope flask by means of an air cylinder.

6. The process of any one of claims 1, 2, and 3, wherein the simultaneous introduction of the molding sand into the lower and upper molding spaces is carried out using a fixed sand-introducing tank, a distal end of which is divided to form fork-like sand introducing ports that communicate with the molding-sand introducing port of the cope flask and the molding-sand introducing port of the lower filling frame.

7. A flaskless molding machine comprising:

an ascendable and descendable lower squeeze board;

a lower filling frame having a molding-sand introducing-port on a surface of a sidewall thereof, wherein the lower filling frame is ascendable and descendable independently from and simultaneously with the lower squeeze board;

a lower squeeze unit that includes the lower filling frame, the lower squeeze board, and a lower squeeze frame, wherein the lower filling frame is connected to leading ends of piston rods of a plurality of cylinders of the lower filling frame, and wherein the cylinders are mounted on the lower squeeze frame in an upward direction, and wherein the lower squeeze frame is ascendably and descendably mounted on at least two columns;

an upper squeeze board that is opposed to and fixedly provided above the lower squeeze board;

an ascendable and descendable cope flask having a molding-sand introducing-port on a surface of a sidewall thereof;

a drag flask that is configured to enter, and leave from, a position intermediate between the lower squeeze board and the upper squeeze board, wherein a match plate is mounted on an upper surface of the drag flask; and an air cylinder fixedly mounted on an upper frame such that the contraction of a piston rod of the air cylinder raises the cope flask.

8. The flaskless molding machine of claim 7, wherein the lower squeeze frame is configured to slidably ascend and descend along the columns by means of bushings that are provided at four corners of the lower squeeze frame.

* * * * *